United States Patent [19]

Topic

[11] 4,359,998

[45] Nov. 23, 1982

[54] IGNITION SYSTEM FOR INTERNAL COMBUSTION ENGINES

[76] Inventor: Eugene F. Topic, 530-3130-66 Ave. S.W., Calgary, Alberta, Canada, T3E 5K8

[21] Appl. No.: 97,973

[22] Filed: Nov. 28, 1979

[51] Int. Cl.[3] ..... F02P 3/04

[52] U.S. Cl. ..... 123/606; 123/637; 315/209 T

[58] Field of Search ..... 123/606, 607, 646, 637; 315/209 T

[56] References Cited

U.S. PATENT DOCUMENTS

| | | | |
|---|---|---|---|
| 3,035,108 | 5/1962 | Kaehni | 123/637 |
| 3,260,299 | 7/1966 | Lister | 315/209 T |
| 3,945,362 | 3/1976 | Neuman et al. | 123/606 |
| 4,051,828 | 10/1977 | Topic | 315/209 T |
| 4,131,100 | 12/1978 | Merrick | 123/637 |
| 4,149,508 | 4/1979 | Kirk, Jr. et al. | 123/606 |
| 4,161,936 | 7/1979 | Volsky | 123/606 |
| 4,192,275 | 3/1980 | Weydemuller | 123/607 |
| 4,245,594 | 1/1981 | Morino et al. | 123/606 |

*Primary Examiner*—Charles J. Myhre
*Assistant Examiner*—Andrew M. Dolinar
*Attorney, Agent, or Firm*—Shlesinger, Arkwright, Garvey & Dinsmore

[57] ABSTRACT

An audio frequency ionization ignition system for internal combustion engines which simulates turbulent combustion (diesel combustion) in spark ignited internal combustion engines utilizing standard equipment with minor changes in the wiring harness of a vehicle. This system includes an electronic contact debounce circuit, an audio oscillator, a divide by two frequency divider and AND circuits combined with power amplifiers. This supplies high voltage, sinusoidal pulses for ignition.

1 Claim, 4 Drawing Figures

IGNITION SYSTEM FOR INTERNAL COMBUSTION ENGINES

BACKGROUND OF THE INVENTION

In the past, ignition systems used cam driven breaker points which would supply 12 volt pulses to an ignition coil. This system suffered from the lack of high voltage at high engine revolutions. Additionally the spark plugs would not burn off the carbon on the electrodes. As the carbon built up on the electrodes, the spark plug would begin to fail. Improvements on this system included capacitive discharge circuits which increase the output potential of the ignition coil. The capacitive discharge and conventional breaker points ignition systems would produce a uniform spreading of combustion within the engine cylinders. However, it has been found that up to 15% of the time, the ignition spark would be blown out. As such the mixture within the cylinders would not ignite and would be exhausted. This of course decreased the engine efficiency.

It has been shown that the problems of spark plug misfirings and ignition spark blowouts can be substantially overcome by producing a high voltage ignition pulse having a frequency between approximately 7 KHZ to 14 KHZ. Typical patents showing this technique are U.S. Pat. Nos. 3,260,299 to Lister, 3,305,108 to Kaehni and 4,131,100 to Merrick.

Some of the problems encountered with the audio frequency ignition systems included, a drop off of voltage at high speeds, instability of the spark frequency as the engine RPM changed and high maintenance cost due to engine heat and vibration. Additionally, many of the prior systems were of a highly complex nature which substantially increased the production costs of the ignition systems.

OBJECTS OF THE INVENTION

One object of the present invention is to provide multiple spark discharges at a precise frequency to the engine cylinders.

Another object of the present invention is to provide high voltage sinusoidal ignition pulses.

Still another object of the present invention is to provide an ignition system which is simple in construction and low in cost.

A further object of the invention is to provide an ignition system which endures the vibration and heat produced in the automotive environment.

Still another object of the invention is to provide an ignition system wherein the spark voltage does not decrease with an increase in engine speed.

Still a further object of the present invention is to provide an ignition system which fully debounces the point contacts.

DESCRIPTION OF THE INVENTION

Figure 1:
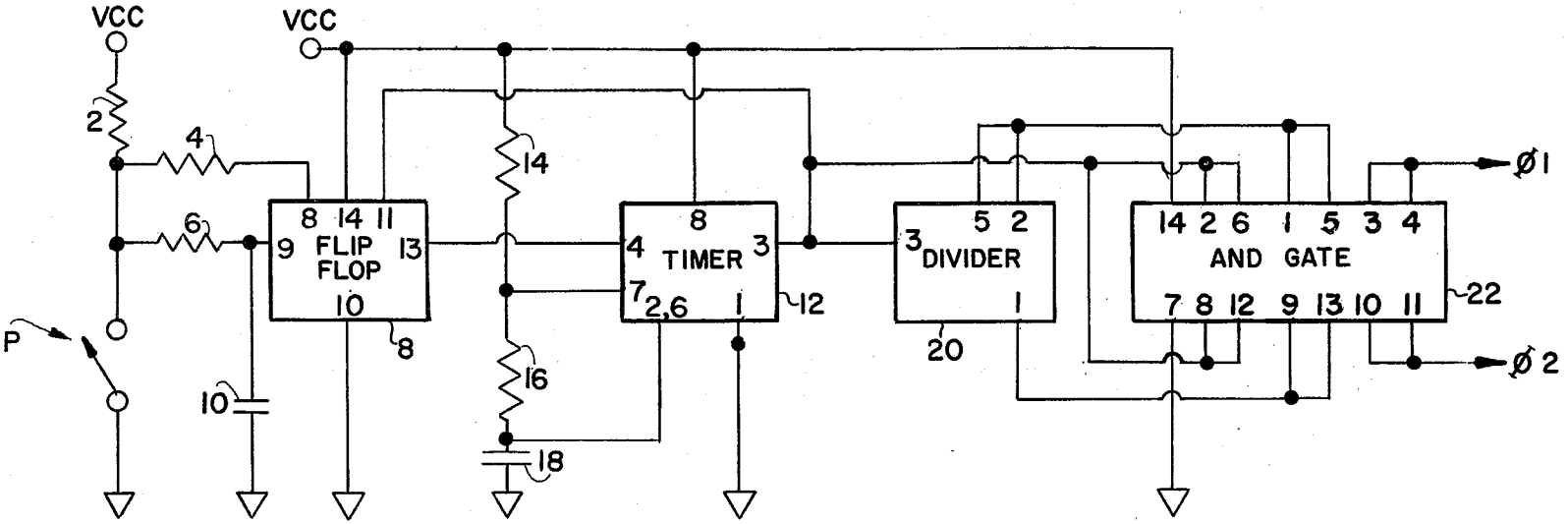
FIG. 1 is a schematic diagram of the contact debounce, oscillator, frequency divider and the AND circuits.

Referring now to FIG. 1, limiting resistor 2 is connected in series with the breaker point P so as to limit the maximum current that can flow to the points P when the points close. Resistors 4 and 6 serve to bias the "SET" and "D" inputs (pins 8 and 9) of flip flop 8. Resistor 6 has associated with it a timing capacitor 10. When the points P close, resistors 4 and 6 ground the "SET" and "D" inputs (pins 8 and 9) of flip flop 8 through the points P. While the "SET" and "D" inputs (pins 8 and 9) are held low, the "Q" output (pin 13) of flip flop 8 will supply a low to the reset (pin 4) of timer 12. This will in turn cause the output (pin 8) of timer 12 to go low.

When the breaker points reopen, the "Q" output of the flip flop (pin 13) will supply a "high" pulse to reset (pin 4) of timer 12 thus enabling the oscillator. Capacitor 10 will charge during this interval (via 6) to approximately Vcc (collector supply voltage).

When the ponts P close again, the set input (pin 8) of flip flop 8 goes "low". However, timer 12 will continue to oscillate for a period of time governed by the time constant created by resistor 6 and capacitor 10. Timer 12 remains oscillating while the output of the timer (pin 3) holds the clock input (pin 11) of flip flop 8 low and the "D" input (pin 9) of flip flop 8 is high. When the voltage across capacitor 10 discharges sufficiently to load a low level into the "D" input (pin 9) of flip flop 8, the output of flip flop (pin 13) places a "low" state on the reset (pin 4) of timer 12. This reset pulse forces the output (pin 3) of timer 12 "low" which then places the timer in a quiescent state.

The timer 12 is a (555) timer connected in an astable multi-vibrator configuration. Resistors 14 and 16 and capacitor 18 are selected so that the output frequency of the timer is approximately 21.4 KHZ. These values are selected by using the following formula:

$$F_0 = \frac{1.44}{(R_a + 2R_b)\,C}$$

$R_1$ is the resistance in ohms of resistor 14.

$R_b$ is the resistance of ohms of resistor 16.

C is the capacitance in micro-farads of capacitor 10.

Figure 3:
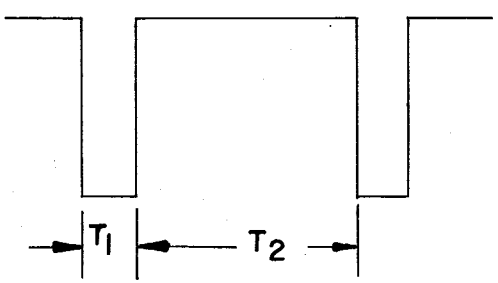
FIG. 3 is a diagram of the time output wave for a collector supply voltage.

The output waveform of the oscillator 12 is asymmetrical as is shown in FIG. 3. Times $T_1$ and $T_2$ are determined by the following formulas:

$$T_1 = 0.693(R_b)C$$

$$T_2 = 0.693(R_a + R_b)C$$

$R_a$ is the resistance of resistor 14 in ohms.

Rb is the resistance of resistor 16 in ohms.

C is the capacitance of capacitor 10 in micro-farads.

Divider 20 divides the output signal from timer 12 by two. If the output signal frequency from the timer 12 is 21.4 KHZ, then each output of the divider (pins 1 and 2) will be 10.7 KHZ.

Integrated circuit (IC) 22 is connected as two "2 input AND gates". Each gate process one of the outputs of divider 20 as follows.

If the Q output (pin 1) of divider 20 goes "high", this output is applied to one of the AND gate inputs (pins 9 and 13) of IC 22. During the time interval $T_1$ (FIG. 3) the other AND gate input (pins 8 and 12) of IC 22 are held "low" and a "low" output (pins 10 and 11) of IC 22 results. As the output signal from the timer 12 enters the time interval $T_2$ (FIG. 3), both AND gate inputs (pins 9 and 13) and (pins 8 and 12) of IC 22 are "high" and a "high" output is produced at the output of the AND gate (pins 10 and 11) of IC 22.

If the Q output (pin 2) of divider 20 goes "high", this output is applied to one of the inputs to the second AND gate (pins 1 and 5) of IC 22. During the time interval $T_1$ (FIG. 3) the other input to the second AND gate (pins 2 and 6) of IC 22 are held "low" and a "low" output is available at the output of the second AND gate (pins 3 and 4) of IC 22. As the output signal from the timer 12 enters the time interval $T_2$ (FIG. 3), both inputs to the second AND gate, (pins 1 and 5) and (pins 2 and 6) of IC 22 are "high" and a "high" output is availiable at the output of the second AND gate (pins 3 and 4) of IC 22.

Figure 2:
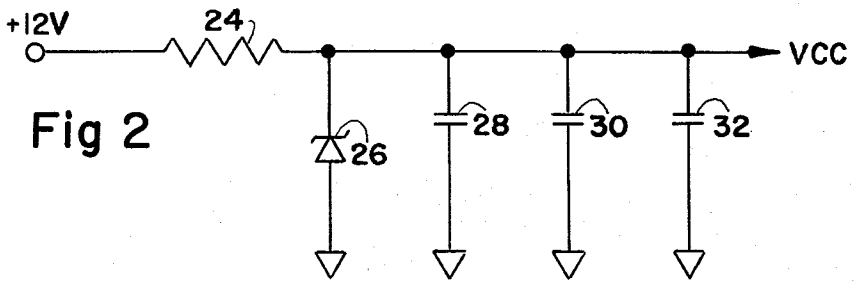
FIG. 2 is a schematic diagram showing the preferred power supply configuration.

Referring now to the power supply, FIG. 2, resistor 4 serves as a current limiter to prevent excess current from being drawn from the 12 volt automotive source. Zener diode 26 provides for voltage regulation should the voltage on the Vcc line exceed the avalance threshold of the zener diode. Capacitors 28, 30 and 32 provide for filtering of the Vcc line in order to bypass to ground noises such as alternator whine and other electrical noise that would be found on the 12 volt automotive source.

Figure 4:
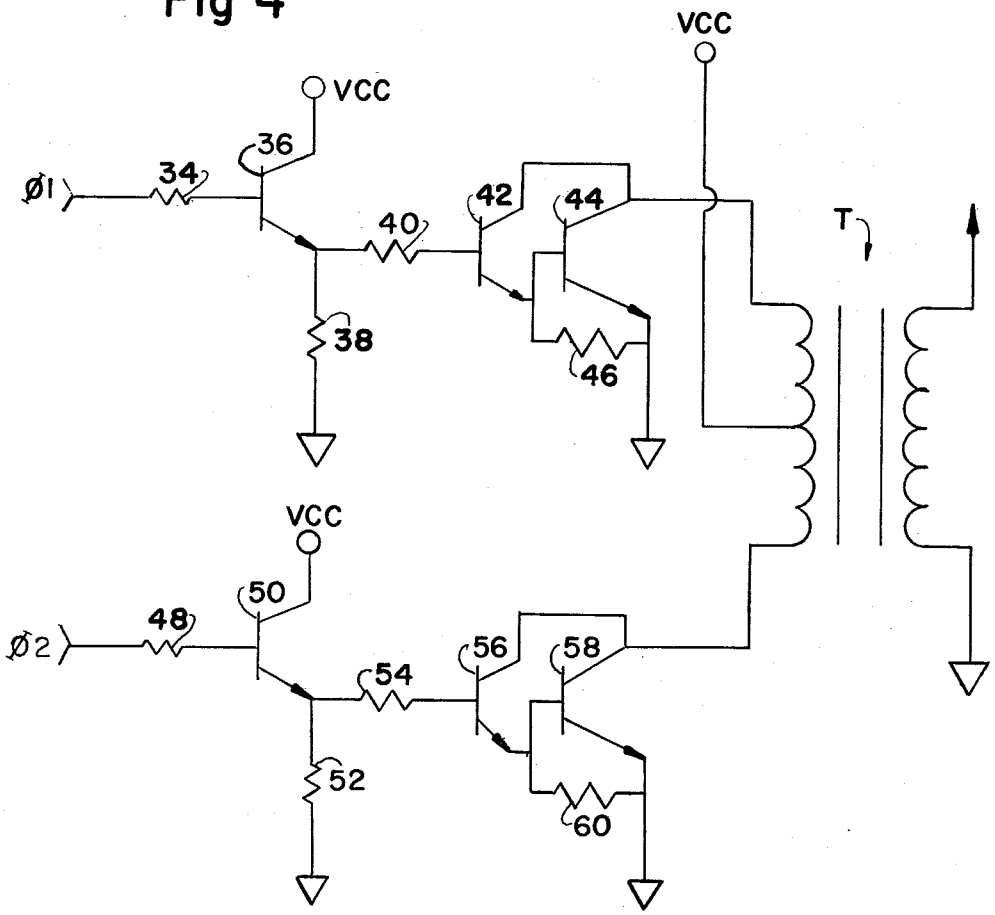
FIG. 4 is a schematic diagram showing the power amplifier and output transformer.

Referring now to FIG. 4, resistor 34 serves to connect the phase 1 output from AND gate 22 to the first amplifier transistor 36. This resistor 34, helps to eliminte spikes generated from the integrated circuits. The output from transistor 36 is regulated by resistors 38 and 40 which provide a voltage divider network. Resistor 40 also serves as the input resistor for transistor 42. Transistors 42 and 44 are connected in a D'Arlington configuration. This configuration provides for an extremely high gain and higher current switching than would otherwise be available. Resistor 46 serves as a bias resistor for the junction of the emitter of transistor 42 and the base of transistor 44. The collector of transistor 44 is connected to one side of transformer T.

Resistor 48 serves to connect the phase 2 output from AND gate 22 to the base of transistor 50. The output signal from transistor 50 is regulated by the resistor network formed by resistors 52 and 54. Resistor 54 also serves as the input resistor for transistor 56. Transistors 56 and 58 are connected in a D'Arlington configuration. Resistor 60 is a biasing resistor for the junction of the emitter of transistor 56 and the base of transistor 58. The collector of transistor 58 is connected to the other side of transformer T.

Transformer T consists of a primary winding and a secondary winding wound on a ferrite core. The primary winding is made of two sections of thirteen turns each. The ends of these primary coils which are not connected to transistor 44 or 58 are connected together and form a center tap. This center tap is fed with a positive direct voltage from the automotive ignition key switch. The secondary coil consists of ten thousand turns wound on the ferrite core. The ferrite core is of the type manufactured by Stackpole Corporation, type number 50-588.

OPERATION OF THE INVENTION

The breaker points debounce circuit is comprised of resistors 4 and 6, capacitor 10, and flip flop 8. When the points "P" close, the "SET and D" inputs of flip flop 8 (pins 8 and 9) are held "low". The output of the flip flop 8 holds the reset input (pin 4) of timer 12 "low". This produces a "low" output on the $\phi 1$ and $\phi 2$ lines (pins 3, 4, 10 and 11) of IC 22. When the breaker points "P" open, the reset (pin 4) of timer 12 is held "high". This starts the timer oscillating. During this time capacitor 10 charges to approximately Vcc through resistor 6.

When the spark cycle is complete, the points "P" will again close forcing the "SET" (pin 8) input of flip flop 8 "low". The "D" input (pin 9) of flip flop 8 is held "high" for a period of time determined by the product of resistor 6 and capacitor 10. While the "D" input (pin 9) is "high", the timer 12 will continue to oscillate. However, when capacitor 10 discharges sufficiently to load a "low" level into the "D" input (pin 9) of flip flop 8 and the output signal of timer 12 (pin 3) switches from "low" to "high", the "Q" output (pin 13) of flip flop 8 is forced "low".

The "low" on the output (pin 13) of flip flop 8 forces the reset (pin 3) of timer 12 "low". This places timer 12 in a quiescent state and the cycle repeats. Since any contact bounce created by the point "P" will be of shorter duration then the time constant determined by resistor 6 and capacitor 10, no adverse effects will be created by the contract bounce.

The timer 12, as was previously noted, is a "555" connected in an astable configuration. The output frequency from the timer 12 is highly stable and typically 21,4 KHZ. However, satisfactory results can be realized when the output frequency is between the audio frequency range of 14 KHZ and 28 KHZ. The output signal (pin 3) of timer 12 feeds the clock inputs to the flip flop 8 (pin 11) and divider 20 (pin 3). Additionally the output signal (pin 3) of timer 12 feeds one input to the first AND gate (pins 8 and 12) and one input to the second AND gate (pins 2 and 6) of IC 22.

When the points "P" open and the timer 12 is enabled, divider 20 will divide the output signal from the timer 12 and provide two outputs (pins 1 and 2) to the AND gate inputs on IC 22. Each output (pins 1 and 2) of divider 20 has a frequency of one half that of the output signal from timer 12. Additionally the divider 20 outputs (pins 1 and 2) will be symmetrical and have a 50% duty cycle.

When the output from the divider (pin 1 or pin 2) is "high" and the output wave form from the timer 12 enters the time interval $T_2$ (FIG. 3), a "high" output is produced at the output of one of the two AND gates (pins 10 and 11 or pins 3 and 4) of IC 22. So while the points "P" are open and for a short period of time after the points "P" close, the output from the first and second AND gates (pins 3 and 4, and pins 10 and 11) will produce an output having a frequency of one half the frequency of the output signal (pin 3) of timer 12.

It should be noted that since the timer 12 produces an asymmetrical output wave form, there will be periods of time when the output from the first and second AND gates in IC 22 (pins 3) and 4, and pins 10 and 11) are both "low".

Transistors 36, 42 and 44 serve as current amplifiers for the $\phi 1$) output (pins 3 and 4) from IC 22. In like manner transistors 50, 56 and 58 serve as current amplifiers for the $\phi 2$ output (pins 10 and11) from IC 22. The collectors of transistors 44 and 58 feed opposite ends of the primary coil of transformer T.

The values of the components in the current amplifier stages, that is to say the components numbered 34 through 60 and the construction of the transformer T is such that the wave form from the secondary of transformer T closely approximates that of a sine wave.

Typical component values are as follows:

| Resistors | |
|---|---|
| Reference Numeral | Resistance |
| 2 | 10 ohms |
| 4 | 100K ohms |
| 6 | 100K ohms |
| 14 | 12K ohms |
| 16 | 120 ohms |
| 24 | 100 ohms |
| 34 | 820 ohms |
| 38 | 1K ohms |
| 40 | 5.6K ohms |
| 46 | 3K ohms |
| 48 | 8.20 ohms |
| 52 | 1K ohms |
| 54 | 5.6K ohms |
| 60 | 3K ohms |

| Capacitors | |
|---|---|
| Reference Numeral | Capacitance |
| 10 | .01MFD |
| 18 | .033MFD |
| 28 | 100MFD |
| 30 | .1MFD |
| 32 | .1MFD |

| Transistors | |
|---|---|
| Reference Numeral | Part Number |
| 36 | PN3567 |
| 42 | 2N3053 |
| 44 | 2N5685 |
| 50 | PN3567 |
| 56 | 2N3053 |
| 58 | 2N5685 |

| Integrated Circuits | |
|---|---|
| Reference Numeral | Part Number |
| 8 | ½CD4013 |
| 12 | 555 |
| 20 | ½CD4013 |
| 22 | CD4081B |

| Transformer | |
|---|---|
| Reference Letter | Type |
| T | Stackpole 50-588 P 2 × 13 Turns enamel copper wire #18 |
| | S Secondary 12,000 turns enamel copper wire #31 |

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the clams.

What is claimed is:

1. An ignition system for an internal combustion engine for providing multiple spark discharges at a frequency of approximately 7 KHZ to 14 KHZ, said ignition system comprising:

an electronic breaker point contact debounce circuit including breaker points and a solid state flip flop device, a solid state audio frequency astable multivibrator connected to and receiving enabling signals from said debounce circuit and generating a first output signal of a frequency of 14 KHZ to 28 KHZ.

a divide-by-two frequency divider for receiving the output signal from said multivibrator and generating a pair of second output signals.

a pair of AND gates, each receiving one of said second output signals and said first output signal and generating third and fourth complementary outputs respectively, first and second two-stage current amplifier circuits for receiving said third and fourth complementary outputs respectively, a step-up transformer having a secondary winding and a center-tapped primary winding, said primary winding being fed at opposite ends by said first and second amplifier circuits for producing a high voltage sine wave output of a frequency of 7 KHZ to 14 KHZ across said secondary winding to said engine.

* * * * *